US006776857B2

(12) United States Patent
Lee

(10) Patent No.: US 6,776,857 B2
(45) Date of Patent: Aug. 17, 2004

(54) METHOD AND DEVICE FOR MANUFACTURING A HOT ROLLED STEEL STRIP

(75) Inventor: Jae-Kon Lee, Pohang-si (KR)

(73) Assignee: Posco (KR)

( * ) Notice: Subject to any disclaimer, the term of this patent is extended or adjusted under 35 U.S.C. 154(b) by 36 days.

(21) Appl. No.: 10/204,909

(22) PCT Filed: Dec. 24, 2001

(86) PCT No.: PCT/KR01/02252

§ 371 (c)(1),
(2), (4) Date: Aug. 26, 2002

(87) PCT Pub. No.: WO02/057032

PCT Pub. Date: Jul. 25, 2002

(65) Prior Publication Data

US 2003/0034593 A1 Feb. 20, 2003

(30) Foreign Application Priority Data

Dec. 27, 2000 (KR) ..... 2000-82820

(51) Int. Cl.[7] ..... C21D 8/02; C21D 9/52

(52) U.S. Cl. ..... 148/661; 148/601; 148/602; 266/113; 133/122 R

(58) Field of Search ..... 148/601, 602, 148/661; 266/113–115; 226/117; 134/122 R

(56) References Cited

U.S. PATENT DOCUMENTS 5,433,650 A 7/1995 Winebarger

FOREIGN PATENT DOCUMENTS

| | | | |
|---|---|---|---|
| EP | 0 796 675 | A1 | 9/1997 |
| JP | 55-010355 | A | 1/1980 |
| JP | 57-001515 | A | 1/1982 |
| JP | 57-134207 | A | 8/1982 |
| JP | 59-163012 | A | 9/1984 |
| JP | 60-061112 | A | 4/1985 |
| JP | 63-20417 | A | 1/1988 |
| KR | 1998-048550 | A | 9/1998 |
| KR | 1999-026910 | A | 4/1999 |

*Primary Examiner*—Deborah Yee
(74) *Attorney, Agent, or Firm*—Webb Ziesenheim Logsdon Orkin & Hanson, P.C.

(57) ABSTRACT

The present invention provides an effective method for mechanically removing iron oxide films formed on the surfaces of a hot rolled steel strip with a high temperature. The method comprises the steps of: maintaining a steel strip coil at a high temperature of 400° C. or more until the phase transformation is completed, after hot rolling; water-cooling the steel strip coil at a speed of at least 50° C./sec to 100° C. or less while uncoiling the coil; correcting the shape of the steel strip using a correction rolling mill; removing oxide films formed on surfaces of the shape-corrected steel strip by injecting water jets to the surface; and drying the steel strip free of oxide films and winding the steel strip. Also, the present invention provides an apparatus for carrying out this method.

11 Claims, 6 Drawing Sheets

METHOD AND DEVICE FOR MANUFACTURING A HOT ROLLED STEEL STRIP

BACKGROUND OF THE INVENTION

1. Field of the Invention

The present invention relates to a method and an apparatus for manufacturing a hot rolled steel strip. More particularly, the present invention relates to a method for manufacturing a hot rolled steel strip, the method capable of effectively removing iron oxide films from surfaces of a hot high temperature coil and having an improved total process rate, and an apparatus for carrying out the method.

2. Description of the Prior Art

Generally, as shown in FIG. 1, hot coils are manufactured by rolling a slab to a certain thickness through a continuous hot rolling mill, cooling the rolled steel strip on a run-out table to an appropriate temperature and then winding the cooled steel strip in coil form by a downcoiler. Immediately after winding, the hot coils have a temperature of about 500 to 600° C. To cool these high temperature hot coils to an ambient temperature, the hot coils are piled up in a coil yard for 3 to 5 days to cool naturally. If necessary, the naturally cooled hot coils are subjected to a shape correction through a shape correction process, for example, a skin pass rolling mill.

The hot rolled steel product is supplied in various forms according to final uses. For example, the hot coil is directly usable as it is. Also, the PO (pickled and oiled) product, which is manufactured by removing oxide films formed on surfaces of the hot rolled steel sheet through a pickling process and then applying anti corrosive oil on the surfaces, may be supplied. The hot rolled steel sheet may be subjected to plating or cold rolling, after pickling. The surface-treated steel sheet product or cold rolled steel sheet product may be supplied.

Meanwhile, the high temperature hot coils drawn from the downcoiler must be cooled to 100° C. or below before these hot coils are introduced into the shape correction process or pickling process. More particularly, since it is known that only when the shape correction process for a low carbon steel is performed at a temperature of 100° C. or less, a coil breakage phenomenon can be prevented; thus, the hot coil must be cooled to the above temperature range.

However, it takes at least 3 to 5 days to naturally cool the hot coils of 500 to 600° C. to 100° C. or below, resulting in lengthening of the production period. Moreover, while the hot coils are slowly cooled over a long period, oxide films formed on surfaces of the steel sheets react with oxygen in air. Accordingly, the thickness of the oxide films is increased, and also compact and adherent oxide films such as $Fe_2O_3$ or $Fe_3O_4$ are formed, thereby making it difficult to perform the pickling process.

As a method for reducing the cooling time for hot coil, a forced cooling method, which is performed by injecting water onto wound hot coil or dipping the coil into water, is known, as disclosed in Japanese Patent Laid-Open Publication No Sho.63-20417, Sho.57-134207 and Sho.55-10355. However, in this conventional method, since water is merely in contact with outer surfaces of the hot coil, an external portion of the coil in contact with water is rapidly cooled, and while an internal portion of the coil not in contact with water has a cooling time of 6 to 24 hours. That is, this method cannot reduce a cooling time significantly. Also, this method has disadvantages in that it causes a deviation of mechanical properties caused by a difference in the cooling hysteresis between the internal and external portions of the coil and between both end portions and a center portion of the coil, and has a low cooling efficiency.

Korean Patent Disclosure No 1999-026910 discloses a method for solving the above problems. This method is a cooling technique that is carried out by winding steel sheets while interposing a steel strip between the steel sheets and then dipping the hot coil into water so that water is infiltrated between the steel sheets spaced apart at a constant interval by the steel strip. This method has an effect of largely decreasing the cooling time. However, the method has disadvantages of the inconvenience of winding the steel sheet together with the steel strip, and deterioration of shape quality caused by the steel strip.

Also, hot rolled steel strips covered with oxide films are first subjected to a oxide film removing process to manufacture PO steel, or to secondary treatment such as cold rolling or plating. Recently, a common method for removing the oxide films is a chemical pickling process as shown in FIG. 2. Chemical pickling is carried out as follows: a wound hot coil is continuously dipped into a strong acid aqueous solution such as hydrochloric acid or sulfuric acid, or injected with an acid aqueous solution while being unwound by an uncoiler. At this time, oxide films formed on surfaces of the hot coil are dissolved into the solution and then removed. Lastly, the hot coil is washed and dried.

However, since the chemical pickling reaction is comparatively slow, the process requires much time and thus has a low productivity. Furthermore, the process needs a large-scale facility including a very long pickling bath with a length of several tens of meters to achieve an appropriate feeding speed. Also, air pollution caused by acid vapors vaporized from the process, the deterioration of working environment, problems caused by corrosion of surrounding facilities and pollution problems caused by continuous generation of acid wastes cannot be avoided.

To improve the inefficiency of oxide film removal and environmental contamination caused by the chemical pickling as described above, various techniques have been suggested. Examples of those techniques include a method of stripping oxide films by a hydrolysis method using a neutral solution and a method for improving pickling by depressing the steel sheet using a roller disposed before a pickling bath, a surface modification using a scale breaker in the form of a leveler and crushing the oxide films through shot blasting. However, these methods are not a complete solution to the above problems and they complicate a facility. Also, a method for stripping oxide films by irradiation of a high-energy laser beam is suggested, but it has a difficulty in productivity and facility operation.

Also, Japanese Patent Laid-open Publication No Sho.57-1515 discloses another method for removing oxide films from a coil. In this method, after hot rolling, a high temperature steel strip coil is dipped into water as it is, and then cooled. Thus, on the surface of the steel sheet is formed a scale layer. Then, the coil is unwound in strips and the unwound steel strip is depressed to crush the scale layer. Thereafter, the crushed scale layer is removed by use of water jet, or strongly spraying an abrasive accelerated by air or water onto the surface of the steel strip.

Korean Patent Disclosure No 1998-048550 discloses a method for manufacturing a steel sheet, which is characterized in that a quenching zone and a dry type descaler are arranged behind a downcoiler of the hot rolling process, and the hot rolling process is connected online to the cold rolling process. This method reduces the cooling time of hot coils and solves problems of environmental contamination by using the pickling-free dry type descaling process. Also, this method can make the entire process continuous and simple.

However, since the process is continuous, it becomes difficult to carry out in the case where the characteristics of the process require a buffer to control flow of materials from the hot rolling process to the cold rolling process. Also, since the pickling-free dry type descaling process is not described in detail, the process is difficult to be realized.

SUMMARY OF THE INVENTION

Therefore, the present invention has been made in view of the above problems, and it is an object of the present invention to provide a method for manufacturing a hot rolled steel strip, which can more efficiently remove oxide films formed on surfaces of the steel strip as well as sharply reducing cooling time.

It is another object of the present invention to provide a method for manufacturing a hot rolled steel strip, which has a reduced process time.

It is yet another object of the present invention to provide an apparatus for manufacturing a hot rolled steel strip, which can more efficiently remove oxide films formed on surfaces of the steel strip as well as improving cooling time and reducing process time.

In accordance with one aspect of the present invention, the above and other objects can be accomplished by the provision of a method for manufacturing a hot rolled steel strip free of oxide films comprising the steps of:

maintaining a steel strip coil at a high temperature as it is at a temperature of 400° C. or more until the phase transformation is completed, after hot rolling;

water-cooling the steel strip coil at a speed of at least 50° C./sec to 100° C. or less while uncoiling the coil;

correcting the shape of the steel strip using a correction rolling mill;

removing oxide films formed on surfaces of the shape-corrected steel strip by injecting water jets to the surface; and drying the steel strip free of oxide films and winding the steel strip.

In accordance with another aspect of the present invention, there is provided an apparatus for manufacturing a hot rolled steel strip comprising:

an uncoiler adapted to continuously supply a hot rolled steel strip coil with a high temperature while unwinding the coil in sheet form;

a quencher including a plurality of cooling-water headers arranged at an upper side and lower side of the steel sheet continuously supplied from the uncoiler, ventilating means for discharging a large amount of water vapor generated during cooling outward, and a plurality of table rollers for feeding the steel sheet, each header provided with nozzles so that the cooling water is discharged to one side of the steel sheet and connected to a cooling water supply source;

a correction rolling mill positioned downstream from the quencher and provided with a rolling roll set for imparting a desired thickness reduction to the steel sheet to eliminate a degradation in shape and non-uniformity of residual stress of the steel sheet fed from the quencher, and generate cracks on oxide film layers;

an oxide film remover positioned downstream from the correction rolling mill, the oxide film remover including pinch roll sets respectively disposed at an inlet and outlet of the remover and adapted to transmit a driving force for feeding the steel sheet, a plurality of guide roller sets arranged between the pinch roll sets while being in contact with upper and lower surfaces of the steel sheet and adapted to prevent the steel sheet from being sagged by its weight and hold the steel sheet so that the steel sheet proceeds at a desired level, means for injecting water jets disposed between the inlet and outlet pinch roll sets and adapted to inject water jets onto the steel sheet at upper and lower surface sides of the steel sheet, thereby removing the oxide films formed on the surface of the steel sheet, and a chamber enclosing the pinch roll sets, the guide roller sets and the water jet injecting means and having slits formed at inlet and outlet sides of the chamber and adapted to allow the steel sheet to pass therethrough;

the water jet injecting means including a pump for generating the water jet, cylindrical water jet headers connected to the pump and adapted to receive the water jets, the headers being arranged in the lateral direction of the steel sheet, and nozzles arranged in a line on each header and adapted to inject the water jets to the steel sheet at a desired inclination angle in the width direction;

a drier for drying the steel strip emerging from the outlet side slit of the oxide film remover; and a recoiler for winding the steel sheet fed from the drier.

The chemical pickling method for removing oxide films formed on surfaces of a hot rolled steel strip has various problems in that it causes contamination, as well as requiring much time and complicated facilities. So, the present inventor studied to develop an improved method for mechanically removing oxide films, which can substitute the chemical pickling method. As the result, it was found that if a high temperature hot-rolled strip drawn from downcoiler would be cooled in an optimized manner, oxide films formed on surfaces of a hot rolled steel strip of the coil had a more coarse structure and was fragile, so that the oxide films could be easily removed by a subsequent mechanical method. Further, the total process speed for manufacturing the hot rolled steel strip can be largely improved due to the increased cooling rate. Based on these findings, the present invention has been completed.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

The present invention will hereinafter be described in more detail with reference to the accompanying drawings.

Figure 1:
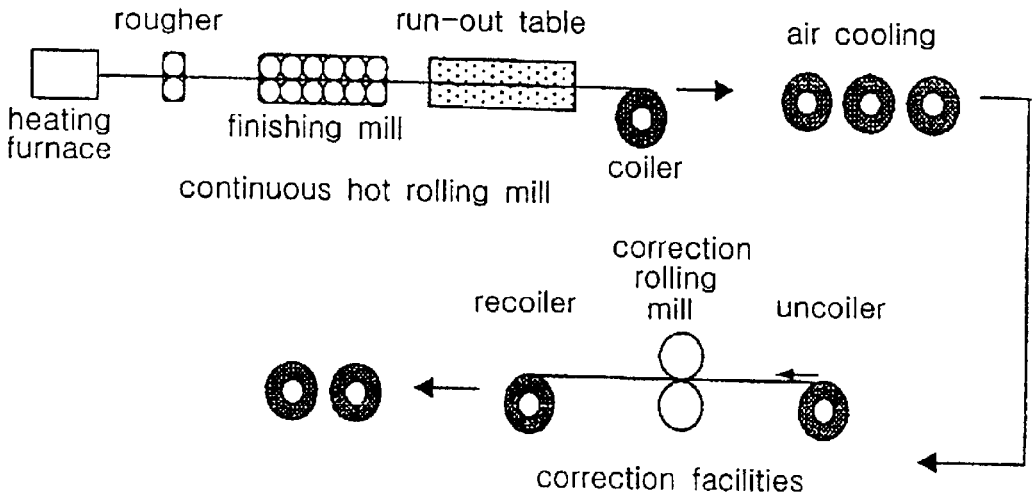
FIG. 1 is a schematic view of a manufacturing process of a conventional hot rolled steel strip.
Figure 2:
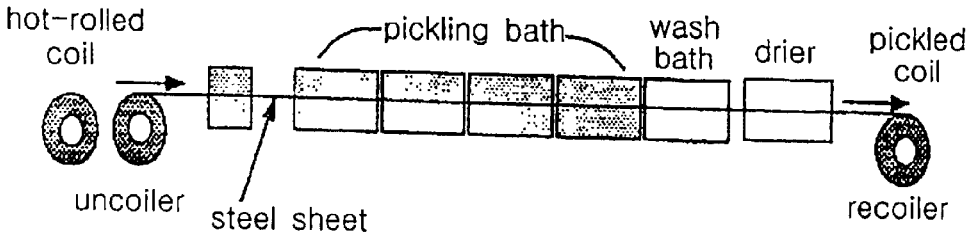
FIG. 2 is a schematic view of a removing process of an oxide film of a conventional hot coil.
Figure 3:
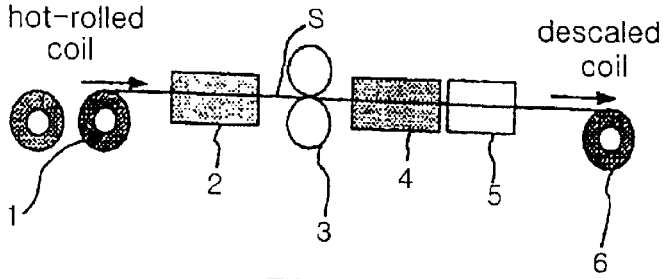
FIG. 3 is a schematic view of an embodiment of a manufacturing process of according to the present invention.
Figure 4:
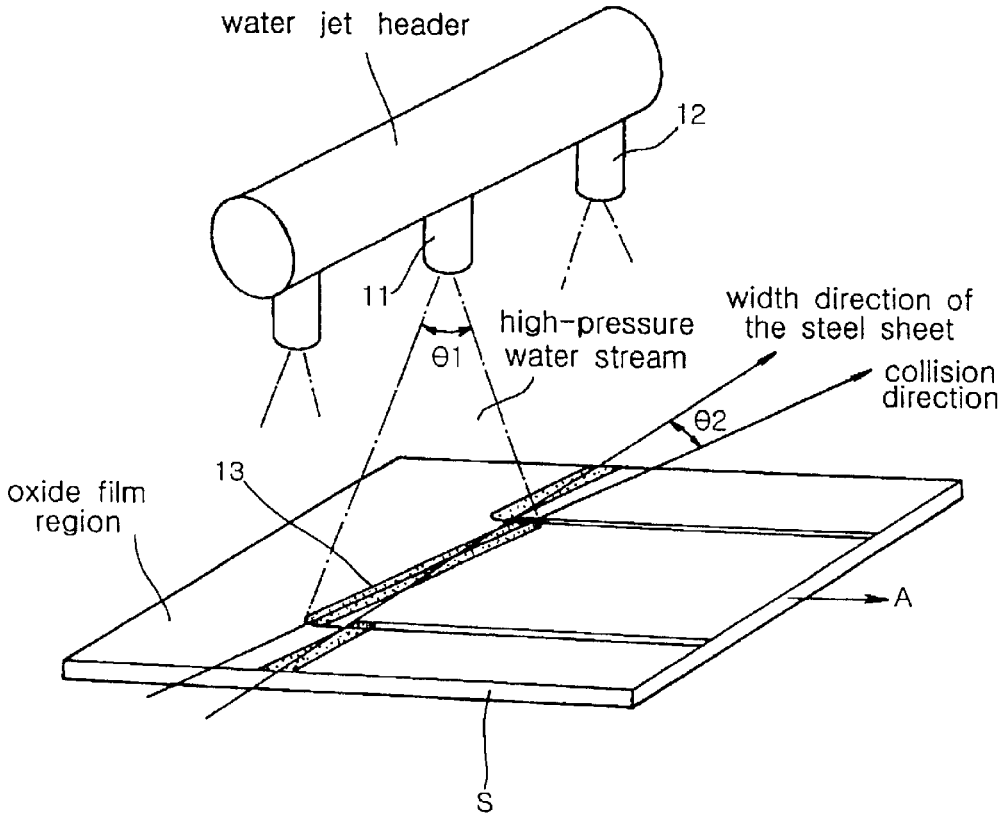
FIG. 4 is a view schematically showing stripping of an oxide film of a steel sheet by a water jet stream according to the present invention.
Figure 5:
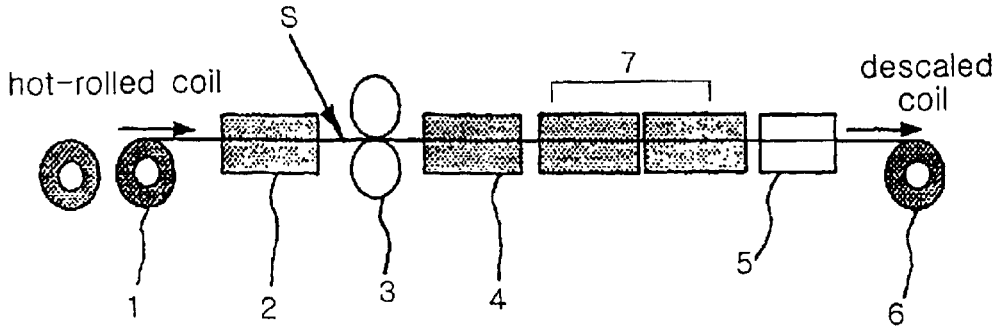
FIG. 5 is a schematic view of another embodiment of a manufacturing process according to the present invention.
Figure 6:
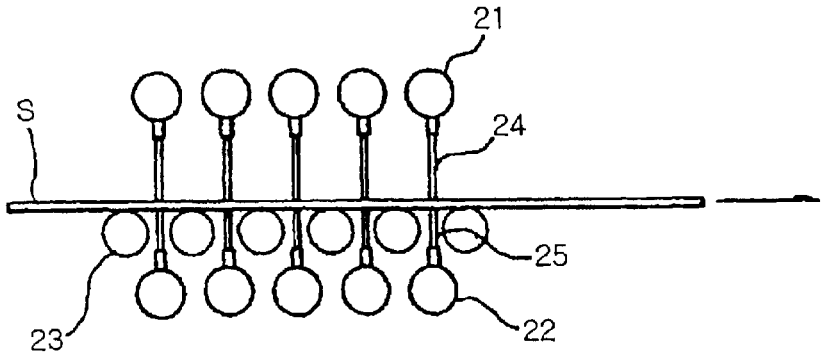
FIG. 6 is a view showing an example of an arrangement of a cooling unit using pipe laminar type nozzles according to the present invention.
Figure 7:
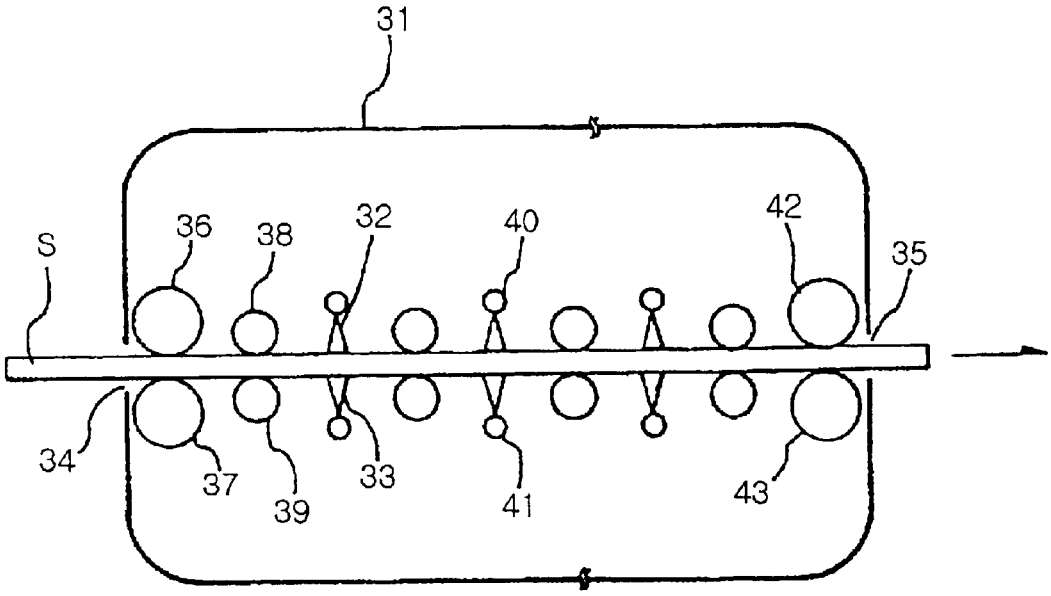
FIG. 7 is a cross-sectional schematic view of a remover of an oxide film using water jet according to the present invention.

FIG. 3 is a schematic view of a manufacturing process according to an embodiment of the present invention. FIG. 4 is a view schematically showing stripping of an oxide film of a steel sheet by a water jet stream according to the present invention. FIG. 5 is a schematic view of a manufacturing process according to another embodiment of the present invention. FIG. 6 is a view showing an example of an arrangement of a cooling unit using pipe laminar type nozzles according to the present invention. FIG. 7 is a cross-sectional schematic view of an oxide film remover using water jets according to the present invention.

In removing the oxide film of the hot rolled coil after quenching the hot rolled strip and correcting the shape thereof, the present invention is characterized in that cooling process, shape-correction process and oxide film removing process are carried out in a continuous process, thereby reducing the cooling time and increasing the efficiency of the manufacturing process. Further, the present invention is characterized in that the strippability for oxide films is improved by the inhibition of growth and transformation of the oxide films through the quenching. Furthermore, the present invention is characterized in that the strippability is also improved by inducing cracking of oxide films along with shape-correction during the shape-correction process.

Hereinafter, the characteristics of the present invention will be described in terms of a manufacturing method, and an apparatus for carrying out the method, with the reference to the process of quenching, shape-correction and stripping of oxide films.

Method for Manufacturing Hot Coil

Quenching

According to the present invention, the quenching process is carried out by rapidly water-cooling a hot rolled steel sheet with a high temperature while unwinding the coil to shorten the cooling time, and improve the strippability of oxide films, without deteriorating the sheet's mechanical properties. To this end, it is required to appropriately control the water-cooling starting time and temperature, the finishing temperature, and cooling rate.

(1) Water-Cooling Starting Time and Temperature

In a continuous hot strip mill unit, a slab is hot rolled into a hot rolled steel sheet. The hot rolled steel sheet is cooled to a predetermined temperature (approximately, 500 to 600° C.) on a run-out table, wound in coil form and then taken out from the unit. Since phase transformations of general carbon steels are mostly achieved on the run-out table, even when the wound coil is quenched while being unwound, there is little change in the steel quality of the coil. Also, steels such as electrical steel sheets or stainless steels, which do not undergo a phase transformation on the run-out table, undergo little change in steel quality.

However, in the case that steels such as high carbon steels or high alloy steels having a high hardenability, which contain a large quantity of alloy elements, are formed into high temperature hot coils, which are undergoing phase transformation on the run-out table, are quenched, austenites having not been phase transformed are transformed into bainites or martensites. Accordingly, the change in the steel quality, that is, the increase in hardness and decrease in elongation and so on is generated, and consequently, a desired steel quality can not been obtained.

Therefore, it is required to terminate the phase transformation by maintaining the coil as it, is for example, for 30 minutes prior to the quenching. Thereafter, the quenching is carried out.

Also, where materials for use in cold rolling requiring processability are quenched immediately after winding, the precipitation of AlN, TiC and so on, which affects recrystallization behavior during annealing after the cold rolling, is not sufficiently achieved, so that the processability of a final product after the cold rolling may be deteriorated. Accordingly, it is preferable to maintain a material for use in cold rolling for 1 hour after drawing, so as to form trace element precipitate such as AlN or TiC or so on, and thereafter quench the material while being unwound.

As described above, according to the present invention, the quenching starts after the steel sheet is maintained for a desired time based on its steel quality. At this time, a hot coil composed of a carbon steel material with a yield point phenomenon has to be cooled at least at 400° C. or more while being unwound in sheet form. This is because in case that uncoiling temperature is less than 400° C., the deformation of the carbon steel material with the yield point phenomenon is locally concentrated, so that a coil breakage phenomenon, which deteriorates the surface quality, can occur.

(2) Water Cooling Finishing Temperature

High temperature hot coils are water-cooled while being uncoiled. At this time, it is preferable that the finishing temperature of water cooling is in a range of 100 or less, more preferably 60 to 100° C. Where the finishing temperature is more than 100° C., a coil breakage phenomenon occurs in the following shape correction rolling process. Also, to decrease the temperature to 60° C. or less, it is required to increase the length of a run-out table. Especially, it is advantageous that the steel sheet contains a certain extent of heat to vaporize residual water in the subsequent processes. Also, it is preferable that the temperature is 80° C.

(3) Cooling Rate

The cooling rate is important in an aspect of improvement of oxide film strippability. During hot rolling, surfaces of a steel sheet react with oxygen in air, thereby forming oxide films. At this time, the oxide films are mainly wustites (FeO). Where the hot rolled steel sheet is slowly cooled for 3 to 5 days by a conventional method, the oxide films become thicker by reacting with air, and at the same time, the oxide films in wustite phase, which have been formed at high temperature, are gradually transformed into magnetites ($Fe_3O_4$) and hematites ($Fe_2O_3$).

During the phase transformation process of the oxide films, the bonding force of the oxide films with the substrate metal is weakened, and the magnetite and hematite, which are transformation phases, have a strong structure and a high breaking strength compared with wustite, which is a high temperature phase, thereby serving to reduce the oxide film's strippability. Therefore, in case that a high temperature hot coil is quenched immediately after winding according to the present invention, the thickness of oxide films is not increased and the transformation into magnetite and hematite is inhibited, thereby serving to facilitate the stripping of the oxide films in the subsequent oxide film removal process.

Also, in case that the steel sheet is quenched according to the present invention, many cracks occur on the oxide films. That is, the oxide film formed on the surfaces of the steel sheet is preferentially cooled at the contacting moment of the steel sheet with water, so that a high instantaneous temperature differential occurs between the oxide films and the substrate metal. In this way, the tensile stress generated by the difference of temperature and the difference of thermal expansion coefficient causes many micro cracks to form on the oxide films, the toughness of which has been reduced due to the cooling. These cracks serve to improve the strippability in the oxide film removal process.

The extent of oxide film growth inhibition, the extent of oxide film phase transformation and the extent of crack generation depend on the cooling rate. The high cooling rate can improve the oxide film strippability, so the cooling rate should be as high as possible. Accordingly, it is preferable that the cooling rate is at least 50° C./sec or more.

Shape-Correction Rolling

The hot coil which has been water cooled to 100° C. or less through the quenching is then subjected to the correction rolling mill. Since the temperature of a steel strip is 100° C. or less at an inlet side of the correction rolling mill, it is possible to avoid the temperature range of 100 to 400° C. where coil breakage occurs, thereby preventing the coil breakage. A skin pass roller is used in a general shaping correction process. The process is carried out by imparting less than several percentages of plastic deformation to the steel strip to correct the distortion of the steel sheet caused by the hot strip rolling and quenching, and to correct the residual stress.

The correction rolling mill according to the present invention plays various roles, besides the correction of the shape and the residual stress as described above. The correction rolling mill serves to mechanically deform the surface of the steel strip to generate cracks on oxide films formed on the surfaces of the steel strip, thereby further improving the oxide film strippability. Also, the base metal at the surface of the steel strip in which shear strain is concentrated is work hardened by the roller, so that the base metal is protected from damage during the subsequent stripping process using a water jet.

The extent of crack generation is increased in proportion to the induced deformation, that is, the thickness reduction rate during the correction rolling. Also, the oxide film strippability is increased by more cracks, accordingly, it is preferable to increase the thickness reduction rate. However, where the thickness reduction rate is 5% or more, the effect of cracking on the oxide films is not increased. Particularly, in case that the steel strip is directly supplied after removing the oxide films, the steel strip product with a high induced deformation has a high toughness and a low elongation. Therefore, it is preferable that the thickness reduction rate is limited to 5% or less. Meanwhile, in cold rolled materials subjected to the cold rolling after stripping the oxide films, the increase of deformation in the correction rolling has an effect of reducing the load of cold thickness reduction rate. Accordingly, it is no problem to impart the deformation of several tens percent (for example, 50%).

Stripping of Oxide Film

After the correction rolling, the oxide films on the steel strip are removed through an oxide film stripper arranged downstream. The stripping according to the present invention is achieved by mechanically stripping oxide films using a water jet, instead of the chemical method using an aqueous acid solution, to remove the oxide films formed on the surface of the steel strip manufactured through the hot strip mill or heat treatment.

A stripping method using water jet is a technique using a descaler with a water jet so as to remove oxide films formed in the heating furnace, during the hot rolling, or so as to remove them prior to the finishing rolling, after the roughing rolling. At this time, since the oxide films are thick and porous and once the oxide films are subjected to thermal shock by quenching, as well as mechanical impact by the water jets, the oxide film is easily removed even by the pressure of generally 300 bars or less.

However, the hot coil cooled to 100° C. or less, as in the present invention, has a comparatively thin and strong oxide film structure and there is nearly no thermal shock effect. Accordingly, it is necessary to inject water jets of at least 1000 bar or more onto surfaces of the steel sheet so as to effectively crush and then remove the oxide films from the surface of the steel sheet. At this point, the injection condition depends on the characteristics of the oxide films, the pressure of the water jets, the flow rate of the nozzle, the space between the nozzle and steel sheet, the contacting angle of the water jet, the feeding speed of the steel sheet, the number of nozzles and so on. That is, where the energy imparted by the water jet on the surfaces of the steel sheet is higher than the bonding energy between the oxide films and the underlying substrate metal, the oxide films can be stripped. Where the energy imparted is insufficient, the complete stripping is not achieved. Meanwhile, where the impact energy imparted by the water jet is excessive, damages such as a dents occur to the base metal.

Also, the strippability varies depending on the state of oxide films, that is, the chemical composition of the steel material, the conditions of the hot rolling, the method of generating cracks on the oxide films through the quenching and the correction rolling for the winding coil such as the method according to the present invention. Accordingly, it is possible to completely remove the oxide films without damaging the base metal by appropriately controlling these variables.

Among these conditions, the most important thing is an available energy serving to strip the oxide films formed on the surface of the steel sheet by the water jet. That is, where this energy is higher than a specific upper limit, the damage to the base metal occurs along with the stripping of the oxide film. Where the energy is lower than a specific lower limit, a complete stripping is not achieved. For this reason, when water jets with a proper energy between these two specific limits are injected, a steel strip with desired surface characteristics, from which the oxide films are completely removed, can be manufactured.

When assuming that "e" is a collision energy transmitted to a steel sheet through water jets discharged from one nozzle per unit time, the collision energy e can be expressed in terms of a discharge pressure P and a flow rate Q, as given in the following Equation 1:

$$e=PQ \qquad \text{Equation 1}$$

where the collision area A of water jet per unit time is determined by a space between the nozzle and the steel sheet h, a jet angle $\theta_1$, a nozzle inclination angle $\theta_2$ and a steel sheet feeding speed v. As shown in FIG. 4, if the nozzle is a fan type nozzle forming water stream dispersed in the shape of a fan, the collision area A of water jet per unit time can be expressed by the following Equation 2.

$$A = 2\tan\left(\frac{\theta_1}{2}\right)\cos(\theta_2)hv \quad \text{Equation 2}$$

Therefore, when assuming that "E" is an energy density transmitted from nozzles per unit area of the steel sheet, the energy density E is expressed by the following Equation 3.

$$E = \frac{e}{A} = \frac{PQ}{2\tan(\theta_1/2)\cos(\theta_2)hv} \quad \text{Equation 3}$$

When quenching and correction rolling treatment are not performed, where the energy density E thus calculated is lower than 3,000 kJ/m$^2$, a complete stripping is not achieved. Meanwhile, where the energy density is higher than 6,000 kJ/m$^2$, it is found that stripping is sufficiently achieved but damage to the base metal directly under the oxide film occurs. Therefore, there is represented the range of an appropriate energy density E, as illustrated in Equation 4.

$$3{,}000(kJ/m^2) \leqq E \leqq 6{,}000(kJ/m^2) \quad \text{Equation 4}$$

However, according to the present invention, stripping of scales is carried out after a hot coil with a high temperature is quenched and then depressed at a thickness reduction rate of 0.5 to 5%. In this case, it is found that the range of the appropriate energy density is relatively large. The range of the appropriate energy density E is expressed by the following Equation 5.

$$1{,}000(\text{kJ/m}^2) \leqq \text{E} \leqq 8{,}000(\text{kJ/m}^2) \quad \text{Equation 5}$$

The reason why the lower limit is decreased is that the oxide film strippability is increased by quenching through water-cooling and thickness reduction through correction rolling. The increase in the upper limit results from work hardening of the base metal directly under the oxide film through reduction. The enlargement of the range of the appropriate energy density in such a stripping of the oxide film means the enlargement of a stable operating range. Particularly, the decrease in the lower limit of the energy density means that it is possible to strip the oxide film by imparting a low energy. Accordingly, the efficient utilization of energy can be achieved.

Meanwhile, in the case where several nozzles are disposed along the feeding course of the steel sheet, the energy imparted to the steel sheet per unit time is proportional to the number of nozzles, but an effective energy density contributing to stripping of the oxide film is not simply increased in proportion to the number. For example, in the case where the number "n" of nozzle headers are disposed along the feeding course of the steel sheet, it is found that where the effective energy density En satisfies the above range, the stripping of the oxide film is appropriately achieved.

$$E_n = \frac{PQn^{0.7}}{2\tan(\theta_1/2)\cos(\theta_2)hv} \quad \text{Equation 6}$$

Therefore, the steel strip having satisfactory surface characteristics is manufactured by configuring the unit so that on the basis of the above presumption equation and range for the energy density, the energy density calculated from the pressure and the flow rate of the ultra-high-pressure pump, the jet angle and the inclination angle of the nozzle, the space between the steel sheet and the nozzles, the feeding speed of the steel sheet and the number of nozzles satisfies the above range. Also, it can be understood that the increase in feeding speed, which determines the productivity, is obtained by increasing the pressure, the flow rate and the number of the nozzle headers, or decreasing the space between the nozzle and steel sheet.

After removing the oxide films through the above processes, the steel strip is dried while passing through a drier disposed downstream to remove residual water. This is because the steel strip can become rusty if its residual water is not completely removed. The dried steel strip is subjected to application process of anti corrosive oil and then rewound by a recoiler to manufacture a PO (pickled and oiled) product or subjected to the successive processes such as cold rolling, plating and so on.

Also, as shown in FIG. 5, a small-scale pickling line can be disposed next to the oxide film remover according to the method of the present invention. That is, some kinds of steel, for example, stainless steel etc. have a very strong bonding force between their oxide films and steel sheets. In this case, since the removal of the oxide films using water jets may be incompletely achieved, the pickling can be used as an auxiliary means for obtaining a more perfect surface by a small scale pickling bath disposed downstream from the oxide film removal line. Of course, the pickling line may be fewer in number and smaller in scale compared with the existing unit. Also, since the pickling speed and the feeding speed of the steel sheet can be increased, the pickling is highly effective in the productivity improvement.

Apparatus for Manufacturing Hot Coil

Quencher

FIG. 3 illustrates a quencher 2 for quenching a hot steel sheet. As the quencher 2, a water cooler of various types such as a pipe laminar type, water curtain type, water injection type or dip type can be used. Since the inlet temperature of steel sheets supplied to the water cooler is 600° C. or more, water cooling is mainly carried out not in a film boiling region but in a nucleation region. Accordingly, quenching can be achieved through direct contact of water with the steel sheet. This is because the cooling power depends more on the flow rate of cooling water rather than the applied cooling type.

FIG. 6 shows a pipe laminar type water cooler as one example of a cooling unit. As shown in FIG. 6, upper and lower cooling water headers 21 and 22 are positioned at upper and lower sides of a steel sheet S. Each of the cooling water headers 21 and 22 are provided with pipe laminar type nozzles arranged in a line. Table rollers 23 are disposed between the headers 21 and 22 to feed the steel sheet S thereon. Cooling is carried out such that the steel sheet comes into contact with upper and lower cooling water jets 24 and 25 discharged from the upper and lower nozzles.

The length of the run-out table is a main factor for determining a desired unit scale upon practically designing an actual cooling unit. The length of the run-out table required to cool a hot steel sheet with a high temperature of 600° C. to 100° C. or less is determined by the thickness of the steel sheet, the feeding speed of the steel sheet, the cooling rate of the steel sheet, and the flow rate of the cooling water. A cooling time of 5 sec is required to obtain the average cooling rate of 100° C./sec. Where the feeding speed of the steel sheet is 100 m/min, the steel sheet is fed by a distance of 8.33 m in 5 seconds. Accordingly, this distance is a minimum length of the run-out table. Where the thickness of the steel sheet is 6 mm, a heat flux of approximately 2.5 MW/m$^{20}$ is required to obtain such a degree of cooling rate. In this case, a flow rate density of about 1500 l/m$^2$/min is also required.

Accordingly, where the maximum width of the steel sheet is 2 m, 2500 l/min of cooling water should be supplied. In the case of a water cooling unit realizing this flow rate density, it can cool a steel sheet of 600° C. with a maximum thickness of 6 mm and a width of 2 m to 100° C. within the cooling section of 10 m. Of course, where either the feeding speed is low or the steel sheet with a thickness of 6 mm or less is cooled, the quenching is more rapidly achieved. Meanwhile, to achieve a more rapid feeding speed of the steel sheet, it is required that the flow rate density is increased, because the water cooling time and the length of the run-out table need to be decreased in inverse proportion to the feeding speed, and the cooling rate needs to be increased in proportion to the feeding speed. Accordingly, it is desirable to appropriately determine the flow rate of cooling water and a pump to be used, taking into consideration the thickness of the steel sheet, the cooling rate, the feeding speed of the steel sheet, the length of the run-out table and so on. However, where the flow rate density is about 1000 $l/m^2$/min or more, and the cooling rate of 50° C./sec or more can be achieved under the condition in which the length of the run-out table is less than 20 m.

Meanwhile, a large amount of water vapor generated during the cooling of the steel strip may cause corrosive problems of the cooling unit. Accordingly, it is preferable to discharge the water vapor appropriately. For example, there is a preferable method of outwardly discharging water vapor generated by installing a ventilating system or forming a water vapor curtain using a chamber enclosing the run-out table, and a fan.

Correction Rolling Mill

In accordance with the present invention, the correction rolling mill as shown in FIG. 3 acts to eliminate a degradation in shape and non-uniformity of residual stress, and to generate cracks on oxide films. As the correction rolling mill, a conventional skin pass rolling unit having shape correction ability can be used. However, common skin pass rolling mills have a maximum, thickness reduction rate of 1 to 3%. Accordingly, it is preferable to install a unit capable of depressing the steel sheet to an extent of 5%. Meanwhile, in case that cold rolled steel materials are manufactured, it does not matter if a rolling mill capable of achieving a thickness reduction rate of several tens of % is used. With this, the thickness reduction rate of the cold rolled steel materials can be reduced.

The correction rolling mill can be in an either dry or wet type. In the dry type, a drying unit for removing residual water from surfaces of the steel sheet is installed between the quencher and the correction rolling mill. In this case, drying can be achieved using compressed air or heated air. Also, it is preferable that after water cooling, the temperature of the steel sheet is maintained at 50 to 80° C., which is not undesirably low, so as to vaporize the residual water with the heat contained in the steel sheet.

Oxide Film Remover

An oxide film removing unit using water jets includes a pump for generating water jet, nozzles for injecting the water jets onto a steel sheet, nozzle headers for supporting the nozzles and supplying the water jets and guide rollers for preventing vibration of the steel sheet and maintaining a desired space between the nozzles and the steel sheet.

FIG. 7 schematically shows the cross-section of a preferable example of an oxide film removing unit. Preferably, a chamber 31 is provided to surround the unit so that the water stream injected from nozzles, splashed water formed by the collision of upper and lower water jets 32 and 33 against a steel sheet, and retention water flowing along the steel sheet are not prevented from flowing outwardly. At the inlet side of the chamber 31 is disposed an inlet side slit 34 with a length determined considering the maximum width of the steel sheet to be processed. Inlet side upper and lower pinch rolls 36 and 37 are disposed at the upper side and lower side just behind the inlet side slit 34, respectively. The inlet side upper and lower pinch rolls 36 and 37 serve to transmit driving force for feeding the steel sheet S, while simultaneously preventing the retention water and the splashed water from flowing outwardly through the outlet side upper and lower pinch rolls 42, 43.

At the upper side and lower side of the pass line, upper and lower guide rollers 38 and 39 are disposed to prevent the steel sheet S emerging from the inlet side slit 34 and the upper and lower pinch rolls 36 and 37 from being sagged by its weight, and maintain a desired space between the steel sheet S and the nozzles. Between the guide rollers are disposed upper and lower water jet nozzle headers 40 and 41. Each of the upper and lower water jet nozzle headers 40 and 41 has water jet nozzles. The water jet nozzles are adapted to remove oxide films and are arranged in a line in the width direction of the steel sheet. It is preferable that the nozzle headers 40 and 41 respectively are connected to upper and lower driving devices so as to change the space between the steel sheet S and the nozzles, if necessary.

As the water jet nozzle, a full cone type nozzle forming a cone-shaped water stream and a fan type nozzle forming a fan-shaped water stream can be used. However, it is preferable to use the fan type nozzle, which is capable of preventing interference of the water streams among the nozzles and at the same time, increasing the oxide film stripping length per nozzle with an equivalent flow rate. The nozzle with a jet angle as large as possible is advantageous because the jet angle determines the extent of coverage. However, too large a jet angle results in non-uniformity of impact pressure. Accordingly, it is preferable that the jet angle is limited to a range of 15 to 45°. Particularly, as shown in FIG. 4, it is preferable that the nozzles are arranged in a line on the water jet header 12 while having a small inclination angle relative to the width direction of the steel sheet S, thereby preventing small interference among water streams injected from the water jet nozzle 11 and allowing adjacent ends of adjacent water jet coverage areas A, where the water jets collide against the steel sheet S, to be slightly overlapped as the steel sheet S is fed in the feed direction A.

It is preferable that the inclination angle $\theta_2$ of each nozzle is as small as possible within the range causing no interference of the water streams among the nozzles, and a proper value of the inclination angle $\theta_2$ is 10 to 20°, and preferably 15°. Meanwhile, the region where the effective collision surfaces are overlapped is determined depending on the space between the steel sheet and the nozzle, the space between the nozzles, the nozzle jet angle $\theta_1$ and the inclination angle $\theta_2$ It is preferable to distribute the collision pressure as uniformly as possible in the width direction by arranging the nozzles such that the length of their overlapped regions is 3 to 5% of that of the collision region. A water jet of 1,000 bars is injected from the orifice of each nozzle at a supersonic speed for a long time. Thus, it is preferable that the orifice is made of a synthetic sapphire or synthetic diamond with a high abrasion resistance so that it is not worn away even after a long time injection of water jet.

The number of the nozzle headers is determined considering the oxide film stripping degree. As shown in FIG. 7, it is preferable that several sets of the headers, for example, two sets or more, are equipped so that the oxide films not stripped by the preceding header are removed by the following header. At this time, it is also preferable that nozzles are alternatively arranged between adjacent headers to provide more uniform stripping in the width direction. The nozzle headers respectively are connected to water jet supply pipes. The supply pipes are connected to a pump for supplying high-pressure water. At this point, valves are disposed at the respective nozzle headers and adapted to inject water jets. It is preferable that the valves are of a by-pass type in order to by-pass water jets in an off state of the nozzles, thereby preventing a fluctuation of the total water jet pressure upon on/off operations of the valves during nozzle-off by bypassing water jet.

Similarly to the inlet side of the chamber, the outlet side pinch rolls and chamber slit are disposed at the outlet side of the chamber to prevent discharge of retention and splashed water, when the steel sheet emerges from the chamber after completion of removal of oxide films. In order to prevent discharge of water, it is effective that the pressure of the chamber is maintained at a pressure below the atmospheric pressure by an air suction pump, so that external air is sucked through a gap defined between the steel sheet and the slit together with the retention and splashed water. After removing oxide films, the steel strip emerging from the outlet side slit passes through a drier. At this time, high-pressure air or heated air can be used to remove residual water.

The present invention will hereinafter be described in more detail in conjunction with Examples.

EXAMPLE 1

Change in Steel Quality of Steel Sheet

A method for cooling a wound hot coil with a high temperature to an ambient temperature by quenching while unwinding the coil can be used only when the steel quality cooled by quenching is not significantly different from that of steel cooled by air cooling for 3 to 5 days using a conventional method. The test for determining the change in steel quality caused by quenching was performed using two representative hot rolled steel sheet materials, low carbon steels and medium carbon steels (low carbon steel: carbon content, 0.042%, manganese content, 1.50%; medium carbon steel: carbon content, 0.19%, manganese content, 1.52%). In this test, the changes in tensile strength were measured using materials manufactured using a conventional slow cooling process which is carried out by air cooling in a wound state for four days after winding, and materials manufactured by cooling at various cooling rates. The results were summarized in FIG. 8.

Figure 8:
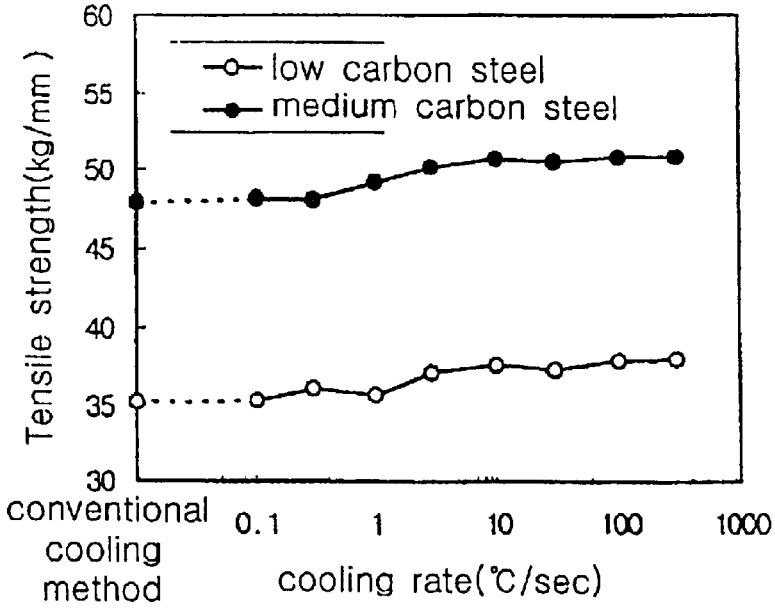
FIG. 8 is a comparative graph of tensile strength of materials cooled by a conventional air cooling method and a change in a cooling rate after winding.

As shown in FIG. 8, in the case of the materials manufactured by the common natural air-cooling method, the tensile strengths of the low carbon steel and medium carbon steel are about 36 kg/mm$^2$ and 48 kg/mm$^2$, respectively. Also, even if the cooling rate is increased to 300° C./sec after winding, the increases of the tensile strengths are insignificant as follows: the tensile strength increases of low carbon steel and medium carbon steel are about 2 kg/mm$^2$ and 3 kg/mm$^2$, respectively. Furthermore, the changes of microstructure observed through an optical microscope were not significant.

The reason why the changes in steel quality are not significant is that the material quality of hot rolled steel sheets is determined by the condition under which a phase transformation of austenite occurs, that is, a cooling condition after hot rolling, and the phase transformation mainly occurs on a run-out table of a hot rolling facility and is mostly terminated before the winding point. That is, the quality change of the materials cooled by quenching is not significant because the phase transformation is already finished.

Accordingly, as suggested in the present invention, it is understood that in case where a wound hot coil is maintained for 30 minutes to 1 hour and then quenched, there is little change in steel quality of a final product, because the hot coil has undergone a phase transformation prior to quenching. However, such a degree of change in steel quality may cause a certain problem. Accordingly, if necessary, it is possible to make the steel quality of steel sheet produced by the present method equal to that of conventional steel sheet increasing the winding temperature during hot rolling or decreasing the content of alloy elements.

EXAMPLE 2

Extent of Removal of Oxide Film Depending on State of Test Piece and Energy Density In this example, the oxide film removal degree was examined for test pieces slowly cooled by a conventional method, and test pieces treated by the method of the present invention, which were made by quenching at a cooling rate of 100° C./sec and then depressing at a thickness reduction rate of 2.5%, after the termination of the phase transformation. As the test pieces, low carbon steel, a representative steel material manufactured in the hot rolling process was used. As the oxide film removal unit, the unit installed with fan type nozzles having a water jet pressure of 2,500 bar, a flow rate per nozzle of 2 l/min and a jet angle of 15° such that its inclination angle is 15°, was used in this example. The removal of the oxide film was carried out under varying space between the test piece (that is, a steel sheet) and the nozzles and feeding speed of the steel sheet using the above unit. At this time, the feeding speed of the steel sheet was changed in a range of 10 to 50 m/min and the space between the steel sheet and the nozzles was varied in a range of 20 to 100 mm to vary the energy density.

Figure 9A:
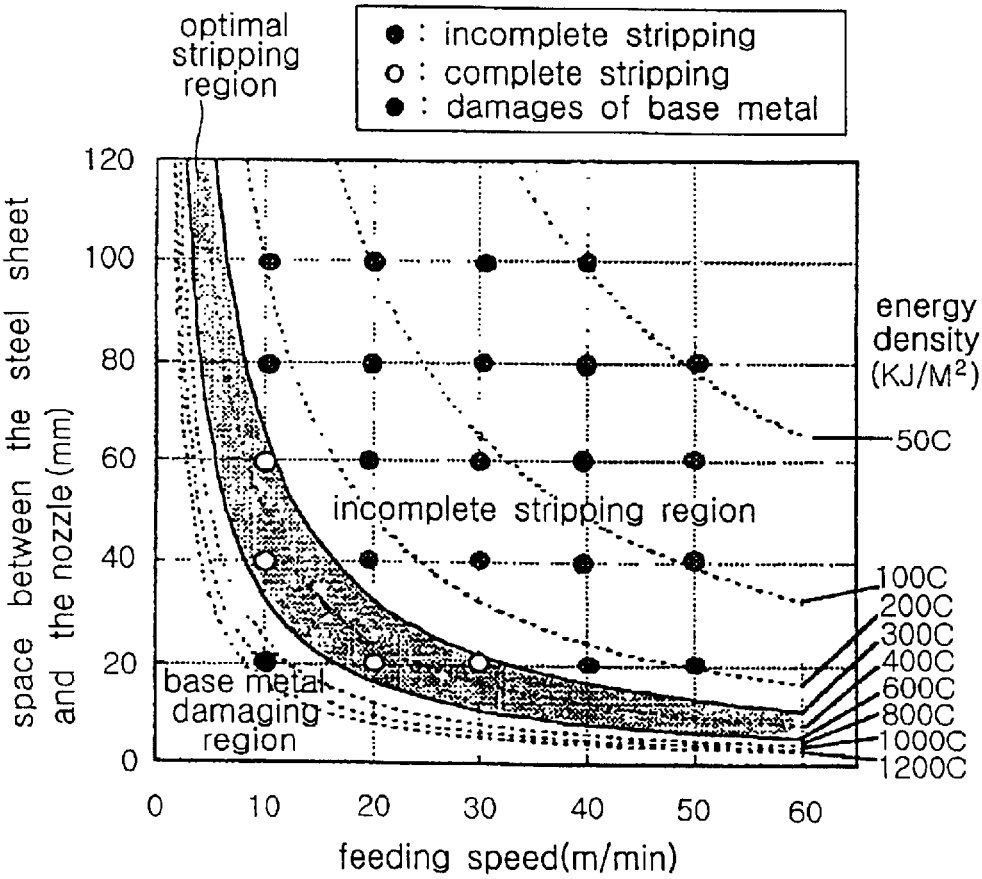
FIG. 9 is a graph of the stripping degree of oxide films depending on a feeding speed of a steel sheet, a space of a nozzle and the steel sheet, an energy density and conditions of test pieces.
Figure 9B:
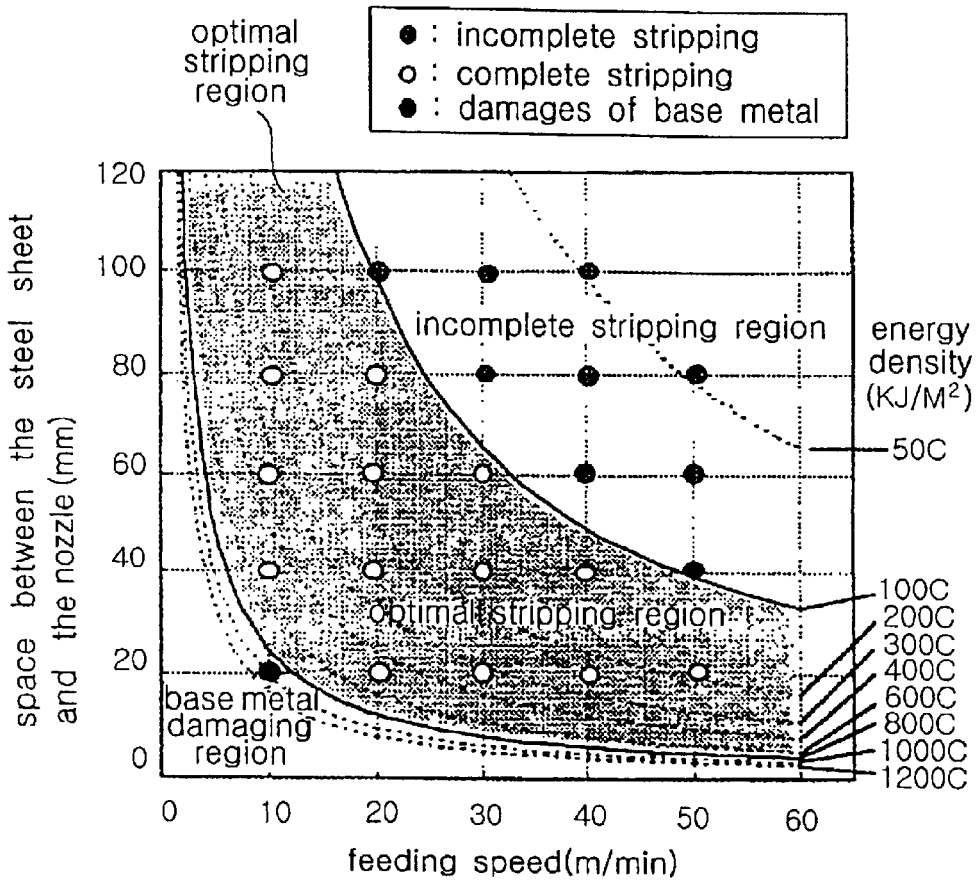

FIGS. 9*a* and 9*b* show the oxide film stripping degree and the change in the energy density E calculated, according to the feeding speed versus the space between the steel sheet and the nozzles, with respect to each condition of the test pieces. As can be seen from these results, the energy densities E are inversely proportional to the space between the test piece (that is, a steel sheet) and the nozzles, and to the feeding speed. Also, the spaces between the steel sheet and the nozzles, where the oxide films are properly stripped, are inversely proportional to the feeding speed. FIG. 9*a* shows the stripping degree of the test pieces which have been slowly cooled by the conventional method, and in this case, an optimal stripping region is narrow. On the other hand, FIG. 9*b* shows the degree of stripping of the test pieces that have been quenched and then depressed by the method of the present invention, and in this case, an optimal stripping region is relatively wide.

That is, in the case where the value of E for a given space between the test piece (that is, a steel sheet) and the nozzles and a given feeding speed of the steel sheet is less than a lower limit of 1000 kJ/m$^2$, oxide film stripping dose not occur. And, in the case where the value of E in the given conditions is larger than an upper limit of 800 kJ/m$^2$, damage of the substrate metal occurs. Therefore, it is understood that the oxide films can be removed easily by quenching a high temperature wound coil and then depressing the quenched coil while carrying out the method of the present invention.

Table 1 shows the comparison of the surface roughness for steel sheets, from which oxide films are removed by a method suggested in the present invention and a common pickling method, respectively.

TABLE 1

| Surface Roughness Stripping method | Ra (μm) | Rt (μm) |
|---|---|---|
| Chemical Pickling | 0.44 | 3.8 |
| Method of the present invention | 0.51 | 4.2 |

As shown in Table 1, it was found that the steel sheet treated by the method of the present invention has almost the same surface roughness as the steel sheet treated according to the conventional pickling method, so that the steel sheet with a satisfactory surface quality can be manufactured according to the present invention.

As apparent from the above description,

First, the present invention can improve the logistics flow and reduce the inventory cost required for a period of air-cooling by omitting a natural cooling process.

Second, the present invention reduces the delivery period and reduces the need for a large-scale coil piling field.

Third, the present invention provides a uniform steel quality because cooling is uniformly carried out all over the length and width of the coil by quenching the hot coil while unwinding the coil.

Fourth, the present invention increases the strippability of oxide films so that the surface quality of the hot coil is improved by formation of micro cracks through quenching and through the inhibition of the phase transformation of the oxide films into magnetite and hematite.

Fifth, the present invention addresses various environmental problems such as air pollution and facility corrosion generated by conventional pickling methods by applying a method of mechanically stripping oxide films using water jets.

Sixth, the present invention provides reduced installation cost because the oxide film removing process is on the whole simplified. In addition, productivity can be largely increased or the pickling unit can be simplified by the combination of the method according to the present invention with a conventional pickling unit.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for manufacturing a hot rolled steel strip free of oxide films comprising the steps of:

maintaining a steel strip coil at a high temperature as it is at a temperature of 400° C. or more until the phase transformation is completed, after hot rolling;

water-cooling the steel strip coil at a speed of at least 50° C./sec to 100° C. or less while uncoiling the coil;

correcting the shape of the steel strip using a correction rolling mill;

removing oxide films formed on surfaces of the shape-corrected steel strip by injecting water jets to the surface; and drying the steel strip free of oxide films and winding the steel strip.

2. The method as set forth in claim 1, wherein the steel strip coil is cooled to a temperature of 60 to 100° C. at the water-cooling step.

3. The method as set forth in claim 1, wherein the water-cooling step is carried out at a cooling water flow rate of 1000 $l/m^2/min$.

4. The method as set forth in claim 1, wherein the shape-correction step is carried out at a thickness reduction rate of 0.5 to 50%.

5. The method as set forth in claim 1, wherein a pressure and a flow rate P of the water jet, a flow rate per nozzle Q, an interval between the nozzle and the steel sheet h, a jet angle $\theta_1$ and an inclination angle $\theta_2$ the nozzle, a feeding speed of the steel strip v, the number of the nozzles in a feeding direction of the steel sheet n is set so that an energy density En of the water jet, calculated by the following Equation 1 satisfies the range of the following Equation 2:

$$E_n = \frac{PQn^{0.7}}{2\tan(\theta_1/2)\cos(\theta_2)hv} \quad \text{Equation 1}$$

$$1{,}000(kJ/m^2) \leq 8{,}000(kJ/m^2) \quad \text{Equation 2.}$$

6. The method as set forth in claim 5, wherein the jet angle of the nozzle $\theta_1$ is in a range of 15 to 45°.

7. The method as set forth in claim 5, wherein the inclination angle of the nozzle $\theta_2$ is in a range of 10 to 20°.

8. An apparatus for manufacturing a hot rolled steel strip comprising:

an uncoiler adapted to continuously supply a hot rolled steel strip coil with a high temperature while unwinding the coil in sheet form;

a quencher including a plurality of cooling water headers arranged at an upper side and lower side of the steel sheet continuously supplied from the uncoiler, ventilating means for discharging a large amount of water vapor generated during cooling outward, and a plurality of table rollers for feeding the steel sheet, each header provided with nozzles so that the cooling water is discharged to one side of the steel sheet and connected to a cooling water supply source;

a correction rolling mill positioned downstream from the quencher and provided with a rolling roll set for imparting a desired thickness reduction to the steel sheet to eliminate a degradation in shape and non-uniformity of residual stress of the steel sheet fed from the quencher, and generate cracks on oxide film layers;

an oxide film remover positioned downstream from the correction rolling mill, the oxide film remover including pinch roll sets respectively disposed at an inlet and outlet of the remover and adapted to transmit a driving force for feeding the steel sheet, a plurality of guide roller sets arranged between the pinch roll sets while being in contact with upper and lower surfaces of the steel sheet and adapted to prevent the steel sheet from being sagged by its weight and hold the steel sheet so that the steel sheet proceeds at a desired level, means for injecting water jets disposed between the inlet and outlet pinch roll sets and adapted to inject water jets onto the steel sheet at upper and lower surface sides of the steel sheet, thereby removing the oxide films formed on the surface of the steel sheet, and a chamber enclosing the pinch roll sets, the guide roller sets and the water jet injecting means and having slits formed at inlet and outlet sides of the chamber and adapted to allow the steel sheet to pass therethrough;

the water jet injecting means including a pump for generating the water jet, cylindrical water jet headers connected to the pump and adapted to receive the water jets, the headers being arranged in the lateral direction of the steel sheet, and nozzles arranged in a line on each header and adapted to inject the water jets to the steel sheet at a desired inclination angle in the width direction;

a drier for drying the steel strip emerging from the outlet side slit of the oxide film remover; and a recoiler for winding the steel sheet fed from the drier.

9. The apparatus as set forth in claim 8, wherein the chamber or the oxide film remover includes an air suction pump for maintaining the pressure of the chamber at a pressure below atmospheric pressure.

10. The apparatus as set faith in claim 8, wherein the nozzle of the oxide film remover is configured to inject the water jet at a jet angle of 15 to 45° in the width direction of the steel sheet.

11. The apparatus as set forth in claim 8, wherein the nozzle of the oxide film remover is configured to inject the water jets at an inclination angle of 10 to 20° in the width direction of the steel strip.

* * * * *

UNITED STATES PATENT AND TRADEMARK OFFICE

CERTIFICATE OF CORRECTION

PATENT NO. : 6,776,857 B2
DATED : August 17, 2004
INVENTOR(S) : Lee

It is certified that error appears in the above-identified patent and that said Letters Patent is hereby corrected as shown below:

Column 16,
Line 23, "$\leq$ 8,000" should read -- $\leq E \leq$ 8,000 --

Column 18,
Line 3, "as set faith" should read -- as set forth --

Signed and Sealed this

Twelfth Day of April, 2005

JON W. DUDAS
*Director of the United States Patent and Trademark Office*